United States Patent [19]

Johnston et al.

[11] Patent Number: 4,817,283

[45] Date of Patent: Apr. 4, 1989

[54] METHOD OF FORMING A MODULAR PLUG COUPLER

[75] Inventors: James J. Johnston, Saybrook; Edward B. Propheter, Cromwell, both of Conn.

[73] Assignee: AMP Incorporated, Harrisburg, Pa.

[21] Appl. No.: 88,177

[22] Filed: Aug. 21, 1987

[51] Int. Cl.[4] ..... H01R 43/16

[52] U.S. Cl. ..... 29/884; 29/883

[58] Field of Search ..... 29/884, 883, 882, 876; 174/52 FP

[56] References Cited

U.S. PATENT DOCUMENTS

| | | | |
|---|---|---|---|
| 3,252,206 | 5/1966 | Stevens | 29/884 |
| 3,574,929 | 4/1971 | Michik | 29/884 X |
| 4,153,327 | 5/1979 | Johnson . | |
| 4,224,485 | 9/1980 | Krumreich . | |
| 4,268,109 | 5/1981 | Hardesty . | |
| 4,269,467 | 5/1981 | Hughes | 29/883 X |
| 4,273,402 | 6/1981 | Hughes . | |
| 4,295,702 | 10/1981 | Snyder . | |
| 4,337,574 | 7/1982 | Hughes et al. | 29/884 X |
| 4,367,908 | 1/1983 | Johnston . | |
| 4,379,609 | 4/1983 | Hardesty . | |
| 4,406,509 | 9/1983 | Jagen . | |
| 4,444,451 | 4/1984 | Myers . | |
| 4,460,234 | 7/1984 | Bogese . | |
| 4,488,355 | 12/1984 | Hutchins et al. | 29/884 X |
| 4,541,174 | 9/1985 | LiBurdi | 29/883 |
| 4,547,964 | 10/1985 | Amano et al. | 29/883 |
| 4,593,966 | 6/1986 | Meyer . | |
| 4,651,418 | 3/1987 | Hutchins | 29/884 |

OTHER PUBLICATIONS

"Modular Interconnection System", Catalog 78-515, p. 2.

"Printed Circuit Board Mounted Modular Jack", Donald W. K. Hughes, p. 1.

*Primary Examiner*—Carl J. Arbes

*Attorney, Agent, or Firm*—Eric J. Groen

[57] ABSTRACT

An electrical coupler for interconnecting two modular telephone plugs includes a housing having two mating faces with openings for receiving the two modular telephone plugs. The terminals within the coupler comprise wire which is formed to include two resilient portions disposed adjacent to the modular plug openings. A terminal subassembly is disclosed wherein a plurality of solid conductors are aligned side-by-side and a web is molded over the span of wires such that when the wires are cut to the desired length, the integrally molded web forms a terminal subassembly for ease of installation of the terminals within the housing.

18 Claims, 10 Drawing Sheets

METHOD OF FORMING A MODULAR PLUG COUPLER

BACKGROUND OF THE INVENTION

1. Field of the Invention

The invention relates to method for forming a coupler of the type of interconnecting two modular plugs.

2. Description of the Prior Art

Couplers used for interconnecting two multiconductor telephone cables wherein each of the multiconductor cables includes a modular plug interconnected to the multiconductor cable are useful as a means for lengthening or splicing multiconductor cable. Such couplers are known in the art as taught by such references as U.S. Pat. Nos. 4,153,327; 4,268,109; 4,273,402; 4,367,908; 4,379,609; and 4,460,234. Most of these references teach using solid conductor wire formed in a variety of configurations to form two sets of resilient contacts such that the single wire can be used to interconnect the blade type contacts of two modular plugs. However, none of these references teach an inexpensive method for inserting the terminals within the housings, as all of the terminals are formed as individual contact members.

References such as U.S. Pat. Nos. 4,224,485; 4,295,702; and 4,406,509 teach inserts which hold a plurality of wires or contacts to the insert such that the insert can be installed within a housing for interconnection to a modular plug. In none of these references, however, is it taught to integrally mold the insert or web around the terminals for ease of manufacturing and ease of handling the terminals as a subassembly. Rather the wires or terminals are individually inserted within the inserts.

A prior art coupler which includes a molded web over the terminals is shown in FIGS. 1A, 1B and 2. However, this coupler does not have a small front mating interface which makes it convenient and useable for a panel mountable electrical coupler. Rather the coupler includes like housing halves which makes the overall housing twice as large as a coupler which is inline. For panel mount purposes, the interface dimensions should be as small as possible in order not to waste panel space.

SUMMARY OF THE INVENTION

It is an object of the instant invention to design an electrical coupler which includes an improved method of handling the terminals which lowers the cost of the coupler.

It is an object of the instant invention to design an electrical coupler which includes a molded web over terminals which increases the ability to handle the terminals.

It is a further object of the invention to design such a web in which a minimum sized web is used.

It is a further object of the invention to design such a web in which the web will not move longitudinally along the terminal length after the molding process.

Such a coupler is formed by pulling solid wires from a reel and aligning them to form a plurlaity of side-by-side wires and thereafter coined to deform the wires transverse to their length, and molding an insulative and integral web over the deformation and over the span of wires encapsulating the wires therein. The webs are molded on longitudinal centerlines such that the length between webs in the desired terminal lengths. The wires are then sheared midspan of the webs to define an integral web which includes a plurality of wires extending from each end of the web. The ends of the wires are formed into the desired configuration and inserted into the housing.

DETAILED DESCRIPTION OF THE PREFERRED EMBODIMENT

Figure 3:
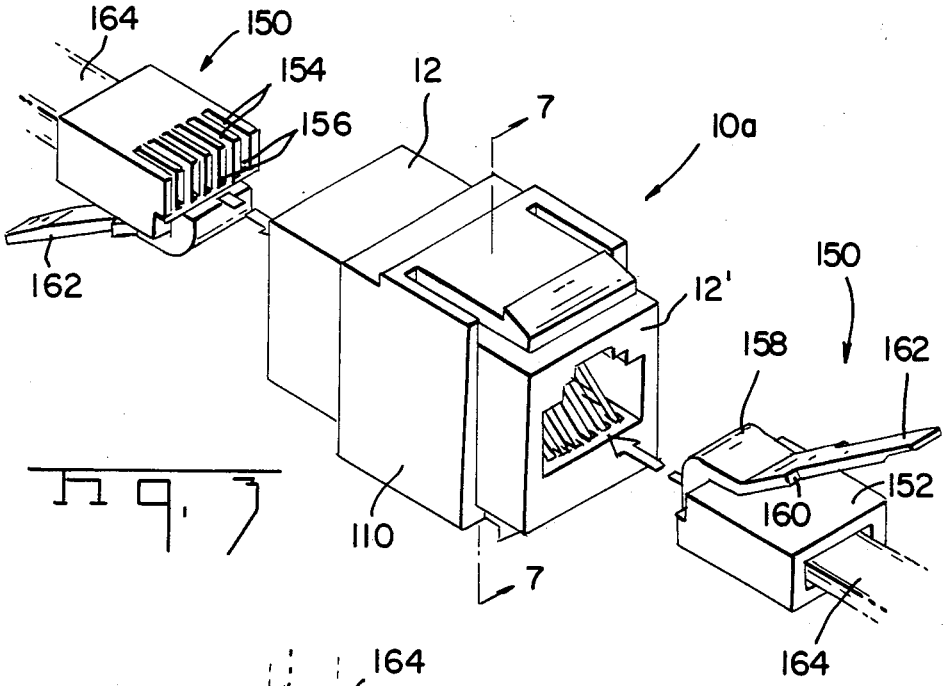
FIG. 3 is an isometric view of an inline modular plug coupler consistent with the subject invention.
Figure 4:
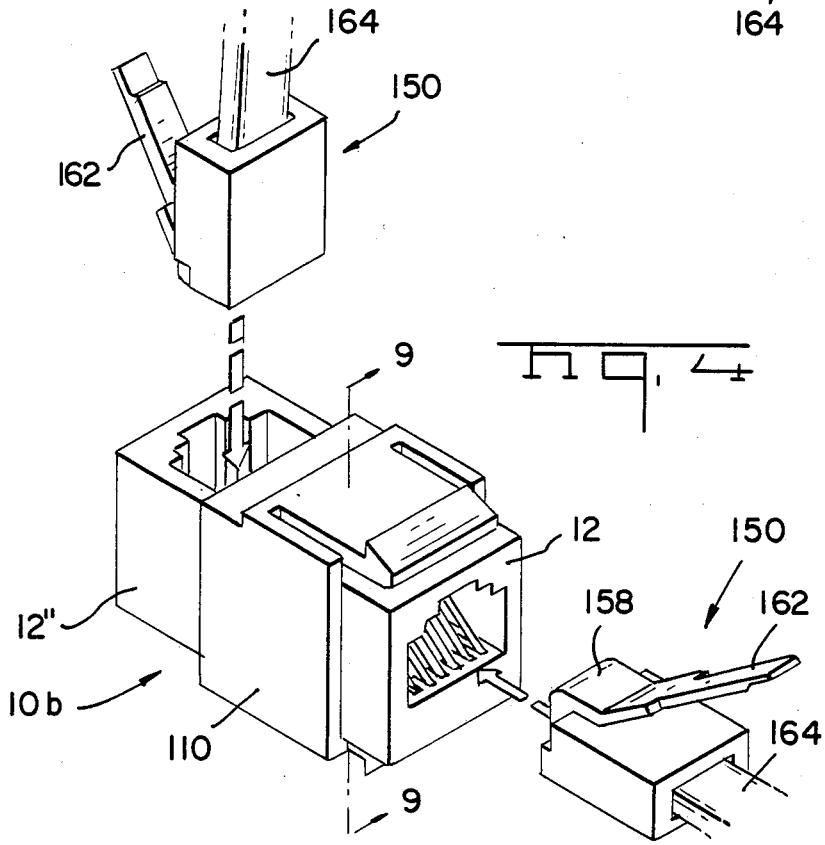
FIG. 4 is an isometric view of a right angle coupler poised for receipt of two modular plugs.

FIGS. 3 and 4 show inline and right angle couplers 10*a*, 10*b*, respectively, for interconnecting two multiconductor cables 164 such as multiconductor telephone cable having electrical plugs 150, typically referred to as modular plugs, electrically connected to each end of the multiconductor cable 164. Modular plugs of this type include housings such as 152 having a polarizing feature 158 with an integrally molded latch member 162 which is resiliently movable towards the housing 152 having latching surface 160. On the side opposite of the polarizing feature 158 is located a plurality of channels situated side-by-side, such as 154, with plate-like terminals 156 which stake through the insulation of the multiconductors to interconnect the conductor of the cable 164. Upon insertion of such plugs, the wire-like terminals of the coupler are aligned and reside in channels 154 to contact the terminals 156 for interconnection of the two plug members 150.

Figure 5:
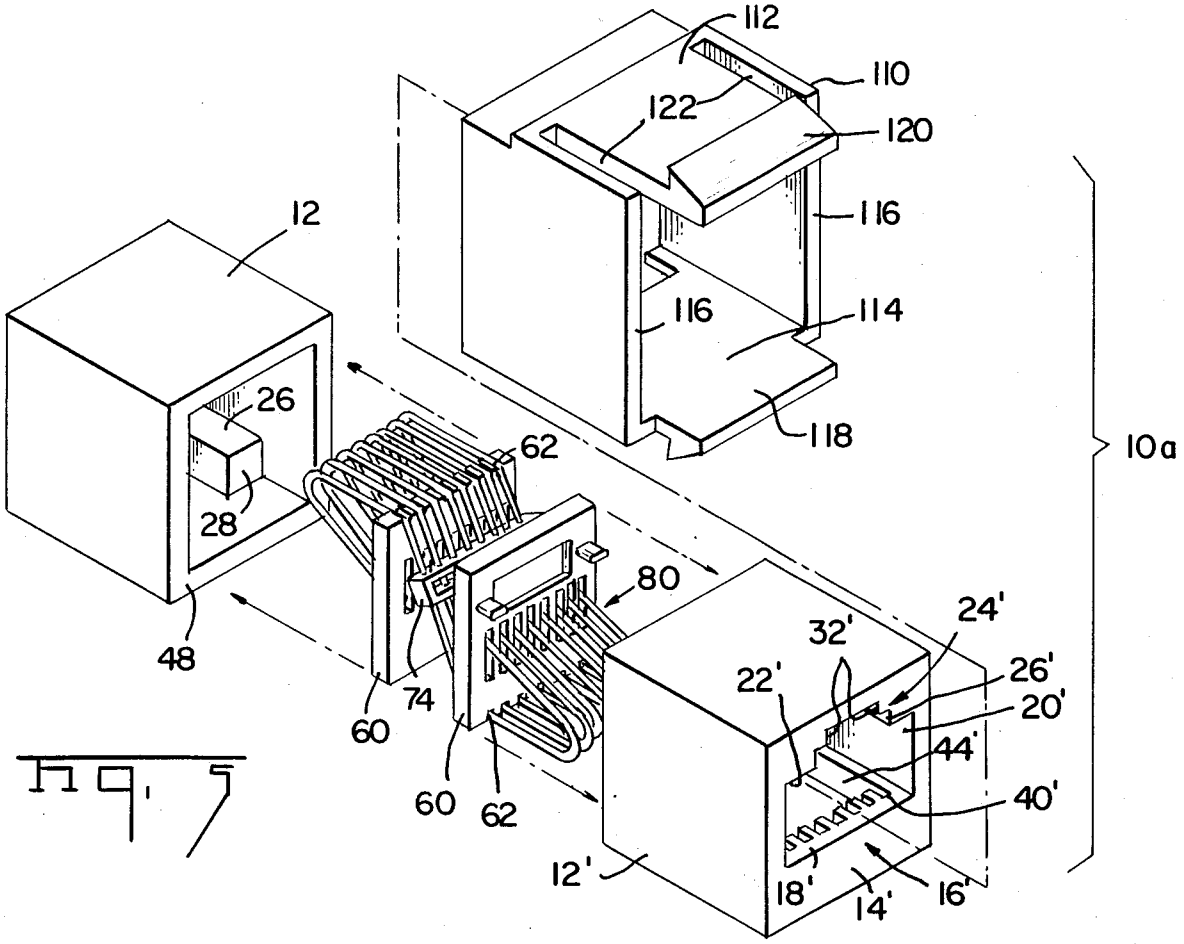
FIG. 5 is a view of the components of the inline coupler exploded away from each other.

With reference now to FIG. 5, the inline coupler 10a will be described in detail. The inline coupler 10a is comprised of two identical housing members 12 and 12' such that description of the one will suffice as a description of the other, bearing in mind that the views are such that the internal structure of each housing 12, 12' cannot be seen in the same figure. Thus, a description of a feature to the housing 12 should be a sufficient description of an equal feature of the housing 12' and vice versa.

Figure 7:
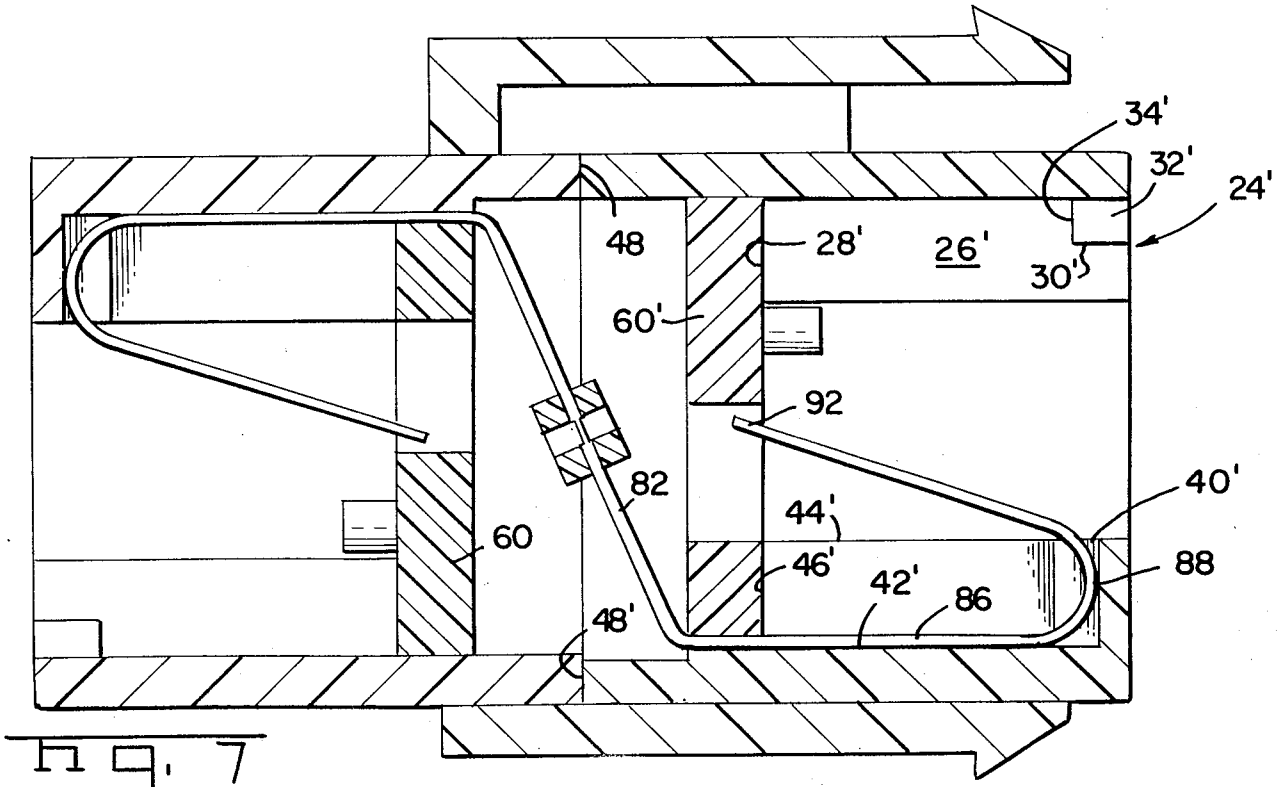
FIG. 7 is a cross-sectional view through lines 7—7 of FIG. 5.

As shown in FIG. 5, the housing 12′ includes a front mating face 14′ having a plug receiving opening 16′ defined by a lower ledge 18′, sidewalls 20′, and an upper ledge 22′. Extending upwardly from the ledge 22′ is an alignment and latching feature shown generally as 24′ which is defined by two ribs 26′ which flank the opening and two alignment lugs 30′ (FIG. 7) having inner sidewalls 32′. Extending downwardly from the lower ledge 18′ are a plurality of channels 40′ which extend downwardly in the same plane as the front mating face 14′ and extend to the bottom wall 42′, as shown best in FIG. 7. Extending along both sidewalls of the housing 12′ are two ribs 44′ which extend rearwardly of the front mating face. As shown best in FIG. 3, the inline coupler is profiled such that the plugs are insertable at an orientation 180° where one is rotated 180° with respect to the other such that the housings 12 and 12′ are also rotated 180° with respect to the other. Therefore, housing 12, as shown in FIG. 7, shows the rib 26 on the bottom whereas rib 44 would be at the top.

Figure 6:
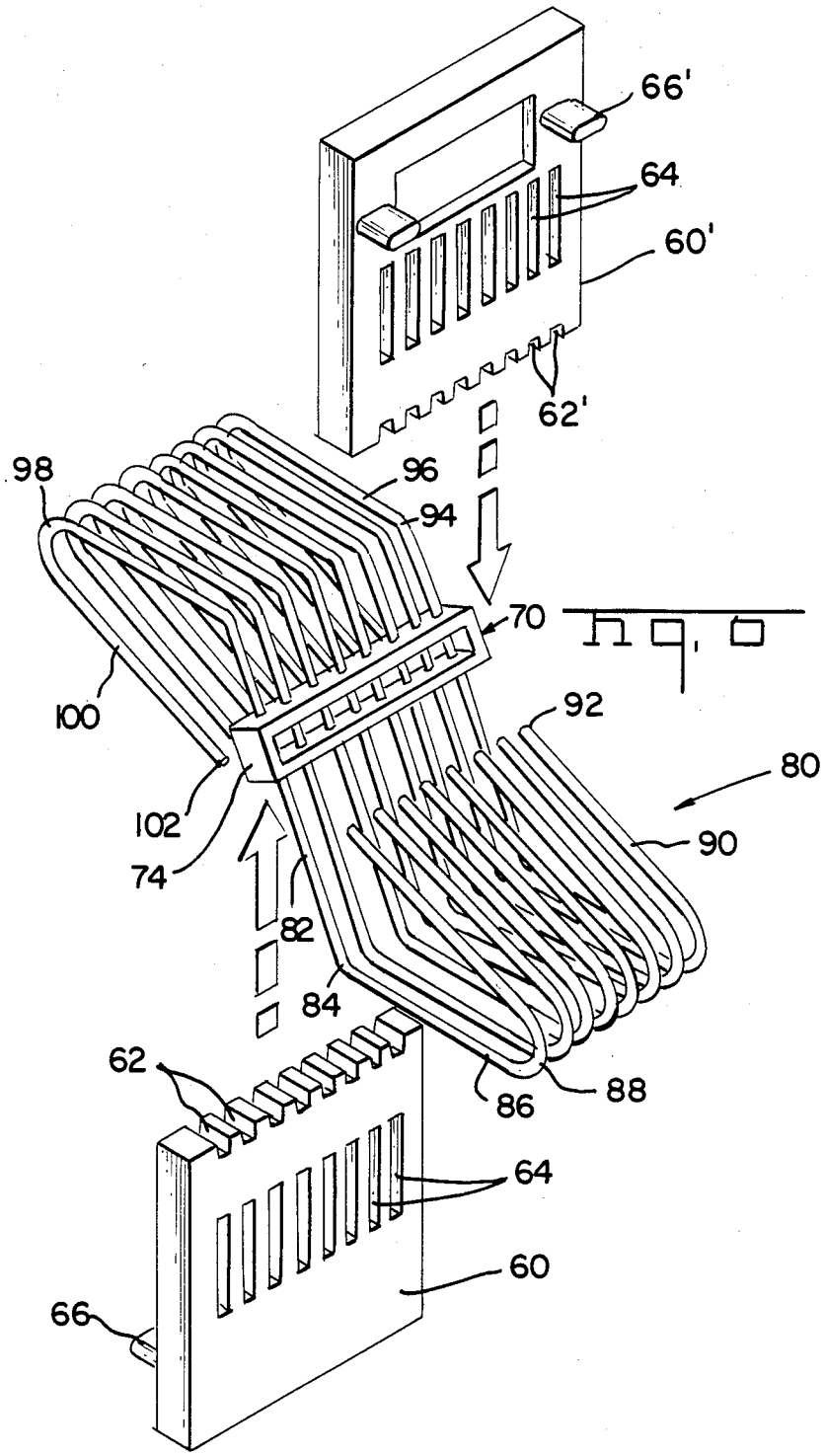
FIG. 6 is an isometric view of the terminal assembly.

As shown in FIG. 6, a terminal subassembly is included, the assembly being joined and held together by an integral web member 70 extending transversely of the terminals, the web being described in greater detail herein. The terminal subassembly 80 includes a section 82 which is commoned to both terminal sections, the first terminal section being formed by a radius 84 which extends into a leg 86, thereafter being formed through a radius 88 which reversely bends the terminals to form resilient contact portions 90 having free ends 92. The second terminal portions begin at the opposite end of the commoned section 82 and are formed through a first radius 94 to define a second leg 96 which is generally parallel with the first leg 86. The leg portions 96 are thereafter reversely bent through a radius 98 to form the resilient contact portions 100 having free ends 102.

Two terminal alignment plates 60, 60′ are also included, each having alignment channels 62 extending along an edge thereof. The plates 60, 60′ also include grooves 64 and 64′ which extend completely through the plates and are aligned with each of the channels 62, 62′. Standoff feet 66, 66′ are further included to space the plates within the housings 12, 12′, respectively.

As shown in FIG. 5, an outer housing 110 is further included having an upper wall 112, a lower wall 114, and sidewalls 116. The lower wall includes an integral stationary latch member 118 whereas the upper wall 112 includes a resilient latch member 120 being integrally formed with the upper wall 112 but being slotted as at 122 along sides thereof allowing the latch member 120 to be movable upwardly and downwardly relative to the upper wall 112.

The right angle coupler of FIG. 4 will now be described with reference to FIGS. 8 and 9. The coupler shown in FIG. 9 comprises subtantially identical housings 12 and 12″, the only difference between housing 12″ and 12 being that the lower wall includes an opening 50″ which is recessed from the back wall 48″ which does not exist on either housing 12 or 12′. Otherwise, the housing 12″ is identical to either housing 12 or 12″.

Figure 9:
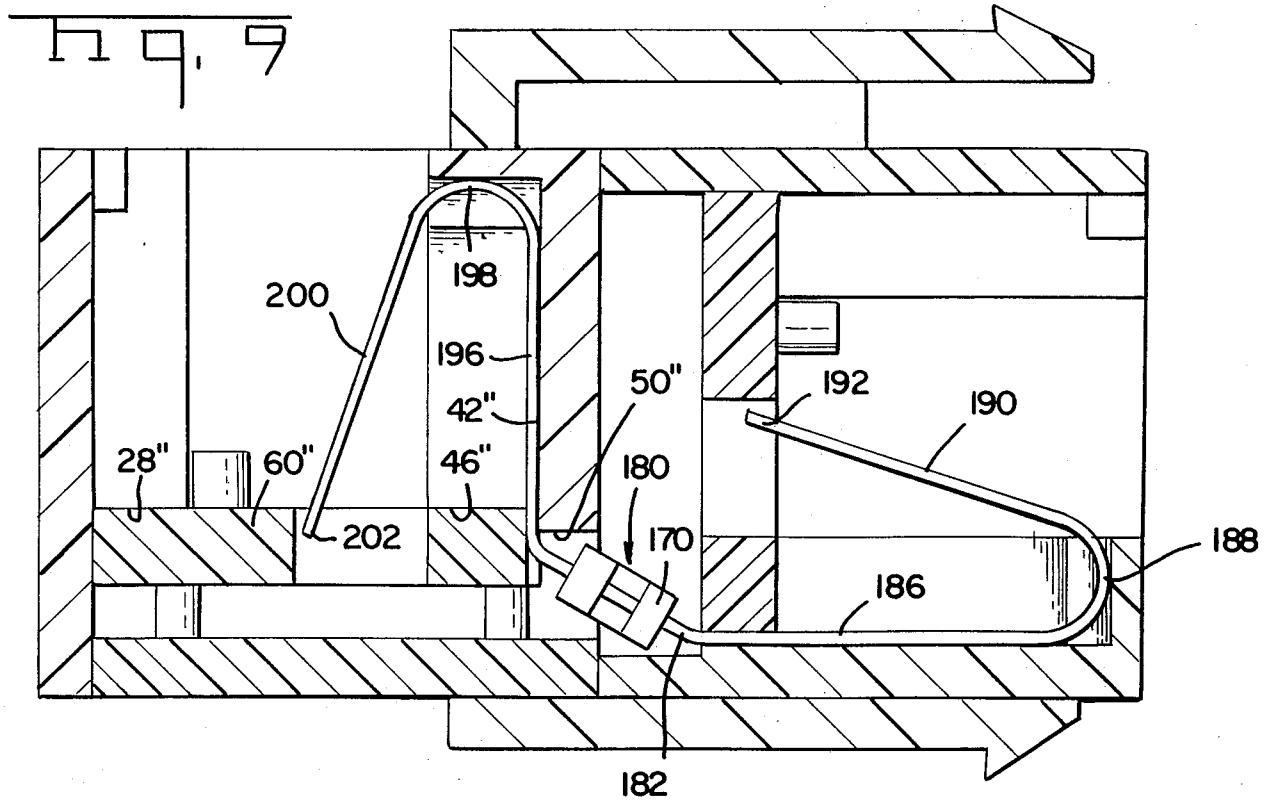
FIG. 9 is a cross-sectional view through lines 9—9 of FIG. 4.

Referring now to FIG. 9, the terminal assembly 180 is similarly configured with the integral web 170, encapsulating the plurality of wires to form a subassembly. However, the terminal subassembly 180 includes legs 186, 196 which are perpendicular to one another and include radiused portions 188, 198, respectively, defining resilient contact portions 190 and 200.

Figure 10:
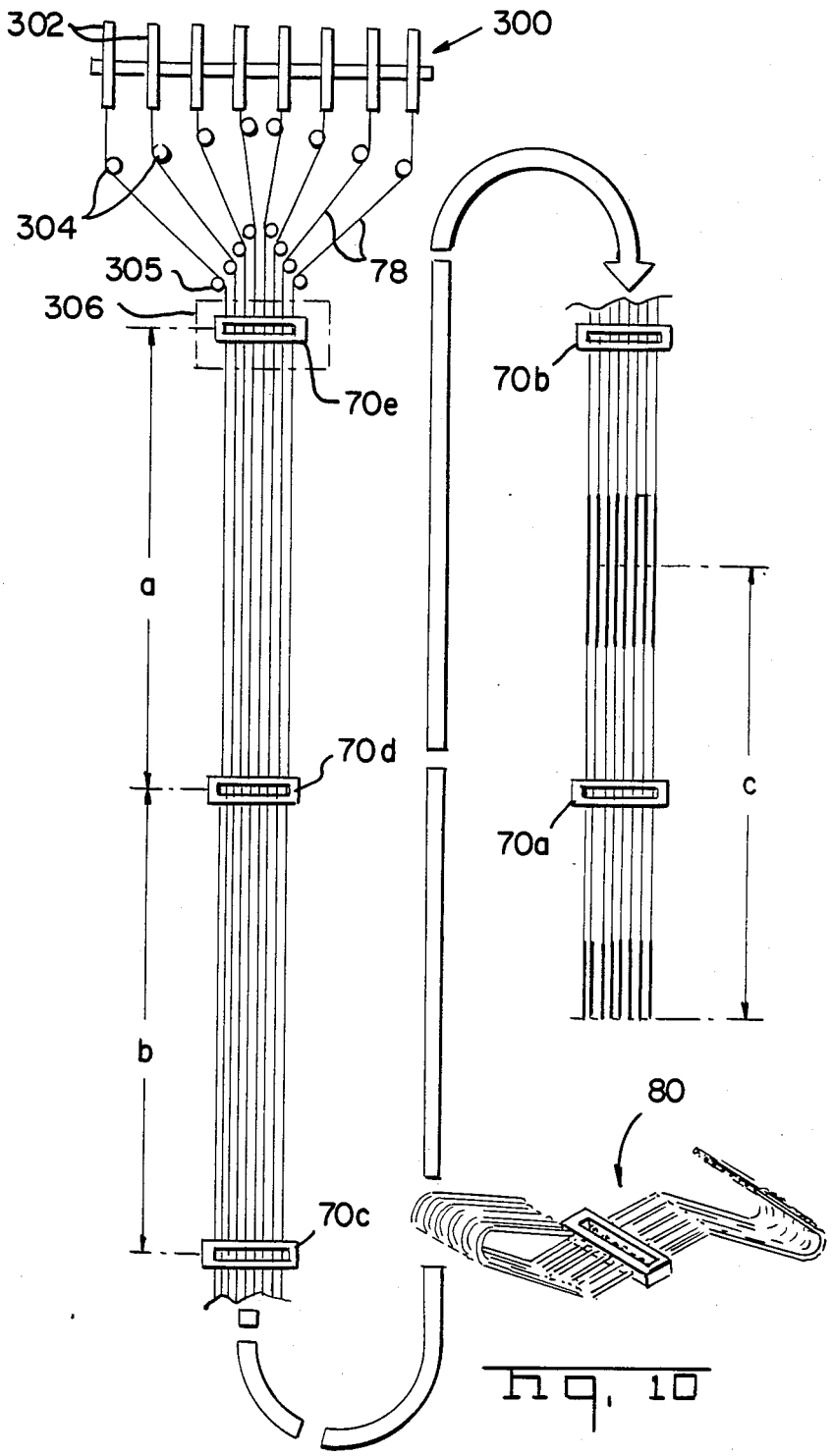
FIG. 10 is a diagrammatical view showing the method of formation of the terminal subassembly.

With reference now to FIGS. 10–14, the formation of the terminal subassemblies 80 and 180 will be described in greater detail. Referring first to FIG. 10, a reel assembly 300 is shown comprising a plurality of reels 302 which would store the individual wire 78 in a rolled configuration. The wires 78 would then be threaded around guide rolls 304 and then further around guide rolls 305 to space the individual wires in the lateral centerlines into which the terminals need to be placed for the end subassembly. The wires overlap a molding assembly 306 which deposits the insulative material over the span of individual wires 78 to encapsulate the wires 78 into the web 70 or 170. The newly formed web 70 or 170 is then moved a distance "a" such that a new span of wires overlie the molding assembly 306 and a new insulative web 70 is formed thereover.

By encapsulating the wire 78 within the web 70, the wires are easily managed and the webs also allow for a registration for further manufacturing. For example, the desired distance between webs 70*c* and 70*d* is a distance "b". Moving the insulative web 70*d* a distance "a" away from the molding assembly 306 will register the new span of wires over the molding subassembly 306 such that the distance "a" between webs 70*e* and 70*d* is equal to the desired length between each of the webs, or such that "a" is equal to "b". The insulative webs 70 also allow for registration of the cutting tools such that the desired wire lengths "c" can also be properly maintained. In the preferred embodiment of the invention, the distance between successive insulative webs 70, that is the distance "b", will be the desired length of the wire for the terminal subassembly. Therefore, by cutting the span of wires at the lengthwise center between successive insulative webs, a terminal subassembly 80 can be formed with the proper length of terminals, the length being shown as "c" in FIG. 10. Once the terminal subassemblies are formed with the desired lengths "c", each of the subassemblies can then be subjected to forming dies to further process the final subassembly 80 or 180.

Figure 13:
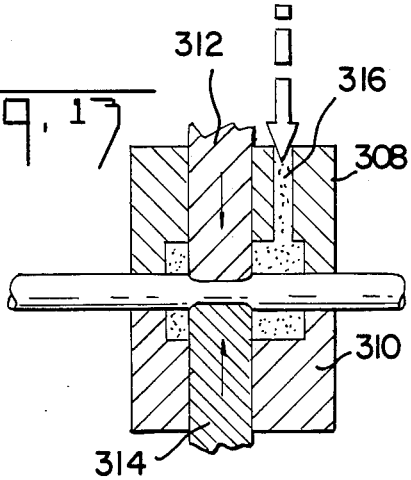
FIG. 13 is a cross-sectional view through the molding dies which would form the integral web.
Figure 14:
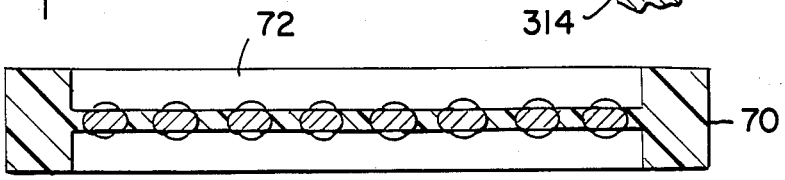
FIG. 14 is a cross-sectional view through lines 14—14 of FIG. 11.

With reference to FIG. 13, the molding assembly 306 comprises upper and lower molding dies 308 which are movable towards and away from the wire 78 to overlie the wire for the molding process. The molding assembly 306 further comprises rectractable upper and lower coining dies 312, 314 which are retractable relative to the lower molding dies to coin the wire at a position integral with the web. Once the webs are coined, molten material is injected through a sprue such as 316 to fill the dies to encapsulate the wire. Retraction of the molding dies 308, 310 and coining dies 312, 314 leaves the webs integrally formed over the span of wires. It should be understood that the coining dies could actually be a part of or integral with the the molding dies 308, 310.

Figure 11:
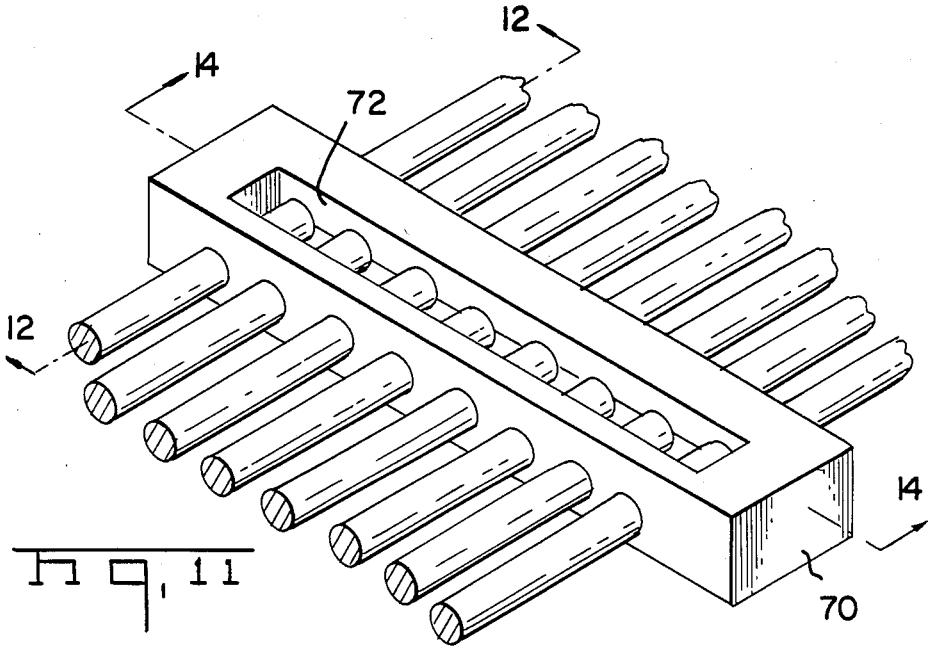
FIG. 11 is an enlarged view of the insulative web which joins the plurality of terminals into the subassembly.
Figure 12:
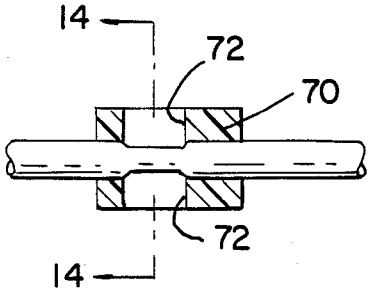
FIG. 12 is a cross-sectional view through lines 12—12 of FIG. 11.

FIG. 11 best shows the integrally formed web in an isometric view where the insulative material encapsulates span of wires to form a terminal subassembly. By leaving the coining dies 312, 314 against the wire during the molding process, two channels 72 are formed above and below the span of wires, as shown in FIG. 11 and FIG. 12. Deforming the wire in some manner by the coining dies is an important aspect of the process as deforming the wire and then integrally molding the web around the deformation prevents the web from moving along the lengths of the wire. This is important for the registration of the webs as they relate to the lengths of the terminal subassemblies and further processes which use the webs as a registration. It should be understood, however, that the wires could be coined in two longitudinal places outside the exterior of the insulative web such that the web is prevented from sliding along the lengths of the wire by two areas of deformed wire exteriorly of the web.

Once the terminal subassemblies are fully formed into either the inline configuration 80 or into the right angle configuration 180, the final assembly of the coupler can be performed. Referring first to the inline coupler 10*a*, the subassembly of the coupler begins with the addition of the plate members 60 and 60'. To install the plate 60' into the position as shown in FIG. 4, the plate is inserted with the channels 62' directed towards the terminal subassembly and with the standoff feet 66' pointing outwardly. The plate 60' is inserted between the common portion 82 and between the free ends 92 and the plate in a somewhat tilted fashion such that the free ends are inserted into the elongate apertures 64'. When in the final position, the wires 78 are positioned within the channels 62' and the free ends of the terminals are positioned within respective elongate apertures 64'. The plate 60 is positioned into the other half of the terminal subassembly in a like manner such that the wires 78 are positioned within the channels 62 and the free ends 102 are positioned within the elongate apertures 64. As shown in FIG. 5, the housings 12 and 12' can now be slidably received over the terminal subassembly 8 and over the two positioned plates 60 and 60' and the two housings can be fixed to each other by means such as an adhesive applied to one of the end walls 48. The outer housing 110 is then slidably received over the two assembled housings 12 and 12' and again adhesively held to a desired position over the two housings 12 and 12'. It should be noted that the other housing 110 can be positioned relative to inner housings 12 and 12' in any desired position such that, if a panel mount coupler is desired, the outer housing 110 is pushed forwardly such that the end of the sidewalls 116 are flush with the front mating face 14' such that the coupler can mount to a face plate with the latches extending through the face.

Referring to FIG. 7 shows the cross section of the inline coupler in a final assembled condition with the endwalls 48 and 48' in an abutting manner and the plates 60 and 60' in a position such that plate 60' abuts the two shoulders 28'' and 46' formed by the two ribs 26' and 44', respectively. As shown, plate 60 resides within the housing 12 in a like manner. It should be noted that the terminals reside within the housing 12' such that the leg portion 86 abuts the floor 42' and the radiused portion 88 resides within the channels 40' while the terminal 92 resides within the elongate apertures 64' of the plate 60'. It should be noted that each individual terminal is retained within the housing at three positions, that is the channels 62' of the plate 60' positions the wires 78 at a position adjacent to the common portion 82, the terminal portion towards the front mating face is retained within the housing by the radius portion 88 being placed within the channel 40', while the free ends of the terminals reside in respective individual elongate apertures 64'.

Figure 8:
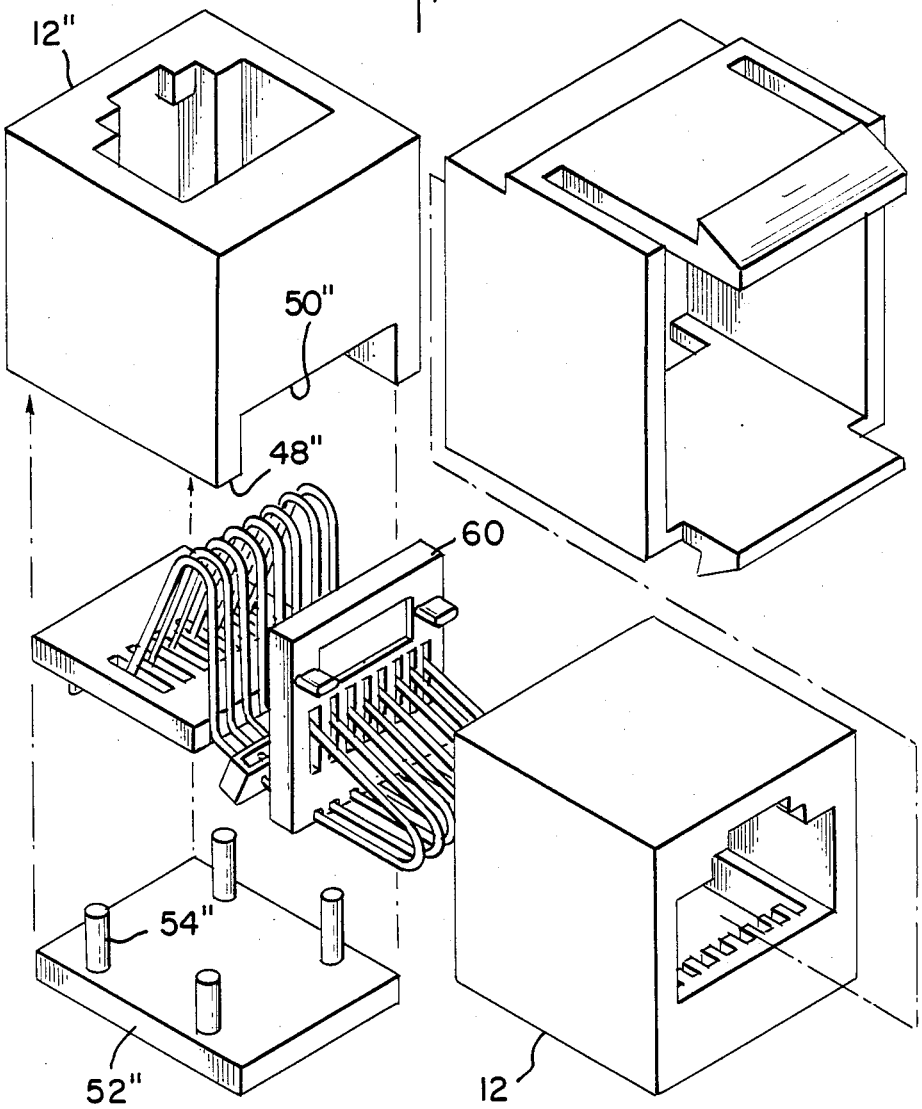
FIG. 8 is an isometric view showing the components of the right angle coupler, as shown in FIG. 4, exploded away from each other.

The assembly of the right angle coupler is quite similar to that of the inline coupler, as shown in FIG. 8. The plates are placed over the terminal subassembly in a like manner to the final position of that shown in FIG. 8 and the first housing portion 12 is slidably received over the terminal in plate 60, as described with respect to the inline coupler. However, the housing portion 12'' must be placed orthogonally relative to the housing 12' such that the lower wall of the housing portion 12'' abuts the back wall 48 of the housing 12. As shown in FIG. 9, which is a cross-sectional view through the final assembly, the opening 50'' provides the recess for the terminal subassembly to enter into the housing 12'' to position the leg portions 196 of the terminals adjacent to the floor 42''. Finally, a cap 52'' is required to enclose the back wall 48'' which includes standoff feet 54'' which abut and position the plate 60'' against the respective shoulders 28'' and 46''.

Figures 1A, 1B:
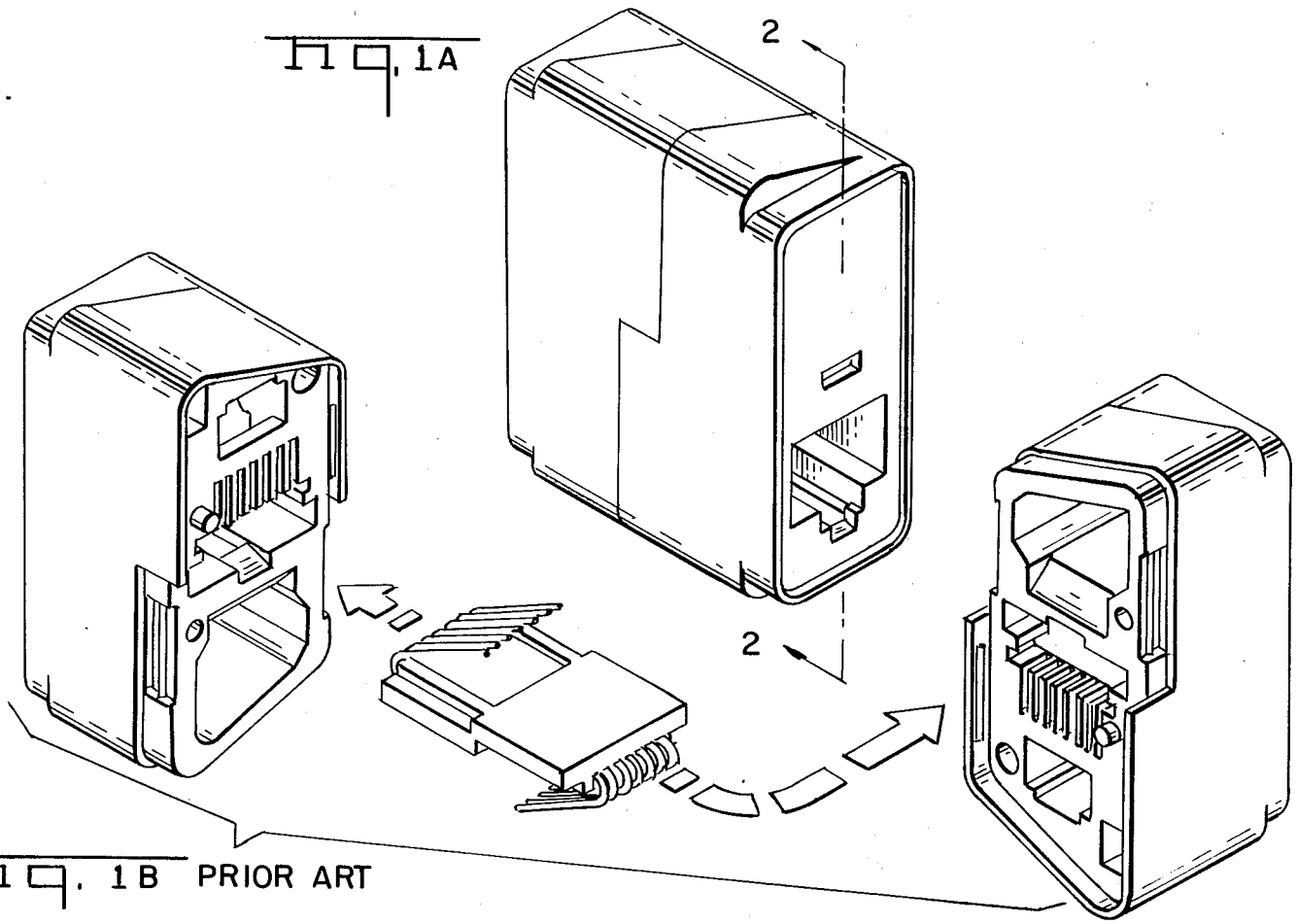
FIG. 1B PRIOR ART
FIG. 1A is an isometric view of a prior art coupler.
FIG. 1B is an exploded view of the coupler of FIG. 1B.
Figure 2:
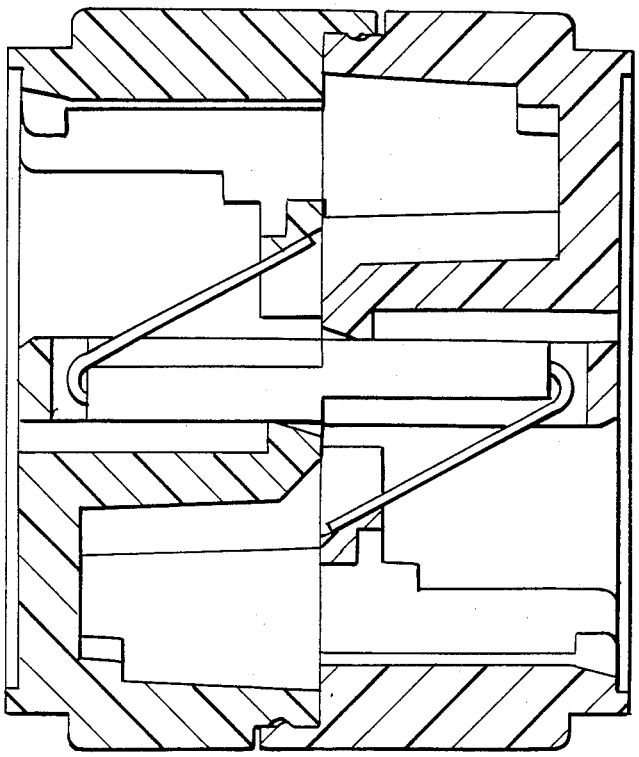
PRIOR ART Fig. 2
FIG. 2 is a cross sectional view through lines 2—2 of FIG. 1A.

With the couplers so assembled, the couplers 10*a* and 10*b* can be used to interconnect two modular plugs such as 150 as shown in FIGS. 3 and 4. When the plug is inserted within one of the openings 16, 16' or 16'' the resilient portions 90, 100; 190, 200 (FIGS. 2, 9) are aligned with the channels 154 and thus ultimately with the blade terminals to interconnect the two plugs 150. Further insertion causes the latch 162 to be cammed downwardly until the shoulders 160 catch upon surface 34, 34', or 34'' (FIG. 7, 9) thereby latching the plug within the coupler.

The invention which I have have just described by way of the figures is the preferred embodiment of my invention but should not be taken to limit the scope of the invention; the appended claims being reserved to that end.

What is claimed:

1. A method of forming a terminal subassembly for receipt in an insulative housing, the method including the sequential steps of:

pulling solid wires from a reel and aligning them to form a plurality of side by side wires;

deforming a portion of each wire;

molding an insulative material over at least a portion of the wires, to form an insulative web over the wires proximate to the deformation, thereby defining a terminal subassembly;

shearing the wires to form two free ends; and forming the wires into the desired configuration.

2. The method of claim 1 wherein the molding step comprises an injection of molten insulative material, and the wires are deformed prior to the said injection of the molten material, at a postion where the insulative web will encapsulate the deformation within the web.

3. The method of claim 2 wherein the deformation is caused by coining the wires transversely of the wire length.

4. The method of claim 1 wherein prior to the molding step, the method includes the further step of coining the wires in a direction transverse to their length to change the cross sectional shape of the wires.

5. The method of claim 1 wherein the integral web is molded to span all of the terminals transversely of their length.

6. The method of claim 1 wherein the molding step includes the step of placing upper and lower die members in a surrounding relationship to the wires and injecting the molding material therein.

7. The method of claim 1 wherein the molding step, prior to the injection step, further includes the step of forcing a coining die against the span of wires such that the wires are deformed and the molded web conforms around the deformation to affix the wires within the web.

8. A method of forming a continuous strip of electrical terminals includes the sequential steps of:

advancing a plurality of terminals in lateral arrays to a position having side-by-side registration in a desired centerline;

deforming the terminals in a direction transverse to their length;

positioning the deformation of said terminals over a molding station;

molding an integral web across the span of terminals to encapsulate said terminals therein;

advancing the web longitudinally to place the terminals in position over the molding station;

molding integral webs across the span of terminals at desired spacings between the webs.

9. The method of claim 8 wherein the distance between the webs is equal to the desired overall terminal length.

10. The method of claim 8 wherein the terminals are sheared to form an overall terminal length equal to the distance between adjacent webs.

11. The method of claim 8 wherein the terminals are sheared intermediate the webs to form two equal terminal halves extending from the webs.

12. The method of claim 8 wherein the deformation is formed by a coining operation.

13. A method of forming an electrical coupler includes the sequential steps of:

providing a plurality of wire reels aligned in side-by-side registration;

directing the said wires to a desired center-to-center spacing;

molding an integral web of insulative material over the entire span of wires to ecapsulate said wires therein;

shearing the wires in a transverse direction to the length of the wires forming two lengths of wires extending from each end of the web;

forming the wires to include intermediate portions which include the web, base portions, and resilient contact portions which are reversely bent from the base portions;

placing a plate means over the wires such that the plate means upstands from the base portions of said wires, the plate means including elongate apertures which receive free ends of the resilient contact portions;

placing the wires and plate means within a housing such that the resilient contact portions are adjacent to front mating faces of the housings.

14. The method of claim 13 wherein the wires are formed to include two parallel base portions interconnected by a diagonal intermediate portion.

15. The method of claim 14 wherein the wires are placed within the housing such that the base portions of a first side are disposed adjacent to a top wall of said housing, and the base portions of a second side are disposed adjacent to a bottom wall.

16. The method of claim 13 wherein the wires are formed to include two perpendicular base portions interconnected by a diagonal portion.

17. The method of claim 13 wherein prior to the molding step, the wires are deformed at a position where the webs will be molded.

18. The method of claim 17 wherein the deformation includes a coining operation and the webs are molded over the deformed portions to encapsulate the deformed portion.

* * * * *